United States Patent [19]

Schaetzle

[11] Patent Number: 4,527,398

[45] Date of Patent: Jul. 9, 1985

[54] CASCADE DESICCANT AIR-CONDITIONING/AIR DRYING PROCESS AND APPARATUS WITH COLD THERMAL ENERGY STORAGE

[76] Inventor: Walter J. Schaetzle, 9 Oak Bluff, Northport, Ala. 35476

[21] Appl. No.: 571,071

[22] Filed: Jan. 16, 1984

[51] Int. Cl.[3] ..... F25D 17/06

[52] U.S. Cl. ..... 62/94; 55/61; 55/179; 55/208

[58] Field of Search ..... 62/93, 94, 271; 55/61, 55/179, 208

[56] References Cited

U.S. PATENT DOCUMENTS

| | | | |
|---|---|---|---|
| Re. 20,933 | 2/1931 | Altenkirch | 62/271 |
| 2,138,684 | 2/1938 | Altenkirch | 62/271 |
| 2,138,686 | 2/1938 | Altenkirch | 62/271 |
| 2,138,688 | 3/1938 | Altenkirch | 62/271 |
| 2,138,690 | 10/1938 | Altenkirch | 62/176 |
| 2,138,691 | 11/1938 | Altenkirch | 62/139 |
| 2,926,502 | 3/1960 | Munters et al. | 62/271 |
| 3,401,530 | 9/1968 | Meckler | 62/94 |
| 3,555,787 | 1/1971 | Lustic | 55/179 |
| 3,812,685 | 5/1974 | Brown | 62/93 |
| 3,844,737 | 10/1974 | Macriss et al. | 62/271 |
| 3,950,154 | 4/1976 | Henderson et al. | 55/179 |
| 4,162,146 | 7/1979 | Seibert | 55/208 |
| 4,180,985 | 1/1980 | Northrup, Jr. | 62/94 |
| 4,205,529 | 1/1980 | Ko | 62/271 |
| 4,227,375 | 10/1980 | Tompkins et al. | 62/271 |

*Primary Examiner*—Ronald C. Capossela
*Attorney, Agent, or Firm*—Oblon, Fisher, Spivak, McClelland & Maier

[57] ABSTRACT

A process using a cascade desiccant air-conditioning-/air drying apparatus having cold thermal energy storage means is used to produce a major increase in the system's thermal coefficient of performance. The latent heat of vaporization from the water separation occurring in desiccant regeneration is recovered in the heating process for desiccant regeneration in the next stage. This energy recovery results in a major improvement in thermal coefficient of performance in air-conditioning or air drying processes. Values greater than 1.0 are expected to be common and values greater than 2.0 are possible. Presently most thermal driven air-conditioning systems have a thermal coefficient of performance less than 1.0 with an average value less than 0.7.

12 Claims, 4 Drawing Figures

CASCADE DESICCANT AIR-CONDITIONING/AIR DRYING PROCESS AND APPARATUS WITH COLD THERMAL ENERGY STORAGE

BACKGROUND OF THE INVENTION

1. Field of the Invention

The present invention relates to air-conditioning systems and more particularly to an air-conditioning system having a cold thermal energy storage capability to reduce the direct thermal energy required for operation of the system.

2. Description of the Prior Art

The principle of using desiccants for air conditioning is widely known and numerous patents, such as U.S. Pat. Nos. 516,313 (November 1931), 2,138,684 (November 1938), 2,138,690 (November 1938), and 3,844,737 (October 1974), are found in the prior art. U.S. Pat. No. 246,626 covering desiccant absorption was granted in November 1881. A number of these patents also note the application of desiccants for direct air drying. Numerous other patents utilize the principle for air conditioning/air drying which has been known since the early 1900's and before. The last patent mentioned makes use of a regenerative zeolite desiccant wheel and a sensible heat exchanger (heat wheel). It provides a viable continuous stream of cool air. The system has been referred to in numerous papers on solar air-conditioning. Many of these presentations used solar energy plus the addition of thermal energy from gas combustion or resistance heating. The problem with these systems is that the thermal coefficient of performance is poor, normally 0.6 or lower. The thermal coefficient of performance is defined as $COP_{Thermal}=Q_L/Q_{IN}$ where $Q_L$ is air-conditioning energy provided by the system, and $Q_{IN}$ is thermal energy required to operate the system. The energy units of both values are identical. The basic conventional absorption cycles, such as water and lithum bromide, have thermal coefficients of performance limited to approximately 0.76.

The low coefficient of performance of these systems limits the use of direct thermal energy to produce air-conditioning economically. This is true for gas sytems, solar systems, electrical systems, and other thermal energy addition systems. However, by doubling the thermal coefficient of performance, a 50 percent reduction in the solar collector area, the major capital cost in a solar system, is possible. Reducing energy input by 50 percent or more in any air-conditioning system is obviously beneficial. This is particularly true as fossil fuel costs rise.

SUMMARY OF THE INVENTION

It is an object of this invention to provide a simple, economical process and apparatus for air-conditioning or air drying having a major increase in the thermal coefficient of performance with respect to present systems.

Another object of this invention is to provide a cascade air-conditioning/air drying process and apparatus having a cold thermal energy storage capability.

Yet another object of this invention is to provide an air-conditioning/air drying process and apparatus which utilizes the latent heat of vaporization stored in the desiccant for subsequent regeneration of other desiccants to reduce the direct thermal energy required to operate the system.

The present invention is directed to an air-conditioning system which utilizes moderate temperature thermal energy for operation, has a built in zero loss thermal energy storage capability, requires a minimum of moving parts, is economical and provides a major increase in thermal coefficient of performance compared to present systems, and can similarly be used as a highly efficient system for direct air drying.

In accordance with the present invention there is disclosed an air-conditioning process and apparatus having a high thermal coefficient of performance by the use of two sets of equipment for completing the process, and using solar or conventional energy. By eliminating the last step in the air-conditioning phase, direct air drying is accomplished. In accordance with the method of the present invention, ambient air and/or internal environment (inside) air is circulated over a desiccant and thereby dried. The desiccant can be silica gel, an absorbent molecular sieve with a high affinity for water, a liquid desiccant, or other similar absorbents. Silica gel, for example, can absorb 50 percent of its own weight in water mass and molecular sieves can absorb 30 to 60 percent of their mass in water mass depending upon the sieve. The dried air and desiccant undergo an increase in temperature due to the heat generated as a result of the drying process. The heated, desiccated air is cooled in a heat exchanger to as low a temperature as possible without using a chiller. The temperature could approach ambient temperature or possibly a lower temperature if water from a cooling coil is utilized in this cooling step. Liquid moisture is then added to the dried air. Adiabatic evaporation of the added water reduces the air temperature and humidity to acceptable values for air-conditioning. Heated, desiccated air at a temperature of 95° F., for example, by the adiabatic evaporation of the added water, can be cooled to 55° F. This is the temperature goal for conventional home or commercial air-conditioners. If only dried air is desired, this water addition step in the process is eliminated. The operation of this system will, after a time, render the desiccant too wet to perform. The desiccant must then be regenerated.

To regenerate the absorbent material the desiccant is sealed from the flow of ambient or inside air and then heated by an external means. Heating can be accomplished by applying heat to the outside of the container holding the desiccant or by running sealed tubes with hot water or steam through the desiccant. The addition of heat regenerates the desiccant and produces water vapor or steam within the desiccant-holding holding container. This water vapor or steam is then transferred to another container of desiccant where regeneration is required. This second unit is also sealed and again steam is produced. This process can continue to third, fourth, fifth, etc. desiccant units. A large part of the energy used in regeneration is recovered and used in a subsequent desiccant unit. Of particular importance is the fact that since succeeding desiccant stages are at lower temperatures, the steam which is generated under pressure condenses and not just sensible heat is recovered but also the latent heat of vaporization. A cascade regeneration process is thus formed. Possible temperatures for a three stage system could be 350° F., 300° .F, and 250° F. for each stage, respectively. The first stage is heated and saturated steam is produced at between 300° to 350° F. Due to the high pressure in the first stage, the steam condenses in the second stage at 300° F. giving up sensible heat and the heat of vaporization. The process is repeated at the third stage at a lower temperature and pressure. Since only part of the input energy to a stage is recovered, each succeeding stage must be physically a little smaller than the preceding stage.

If each stage has an independent thermal coefficient of performance, and 90 percent of the energy is recovered, and if each succeeding stage is 90 percent of the size of the last stage, then the overall thermal performance is:

a. 0.5 for one stage
b. 0.95 for two stages
c. 1.36 for three stages
d. 1.72 for four stages
e. etc.

The systems use energy recovery, including latent heat of vaporization recovery, for successive desiccant regeneration.

In order to form pressurized steam, the desiccant must collect a large percentage of its mass in water and regenerate the water. For example, if Linde 13× molecular sieve is used as the desiccant, a mass of water equivalent to over 30 percent of its mass can be absorbed. If this water is transformed to saturated steam at 350° F., the container can physically contain only 10 percent of the steam. This means the remaining 90 percent of the steam must be forced out of the container to the next unit. With higher mass percentage absorption and/or lower temperatures and pressures, a higher percentage of steam is forced from the container. If the temperature of the next unit is lower, the steam will condense in the heat exchanger coils. The condensation of the steam is a critical requirement of this invention. The condensation requirement necessitates that the desiccant units be well charged prior to regeneration.

Once the desiccant is regenerated, the system can provide air-conditioning according to the above described process without energy addition until the desiccant is again near saturation. During this period the desiccant is providing cold thermal energy storage without thermal losses. The quantity of the thermal energy storage is determined by the mass of the desiccant.

By utilizing two or more complete systems as described hereinabove the air-conditioning process can be made to operate continuously. While one or more systems are being regenerated, the other systems can be used for regeneration. Sizing each system of the two or more systems so as to provide 24 hours of air-conditioning would allow solar energy to be used for regeneration. If insolation is not available during a given day, the system could be regenerated with lower priced electricity during off-peak hours.

A system using conventional thermal energy, such as natural gas, would use smaller units and possibly recycle thereby regenerating the desiccant every thirty minutes. A continuous operating system using liquid desiccant is also a possibility.

The invention can more than double present thermal coefficients of performance, is simpler than most present systems, and has a lower capital cost than most present systems.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1:
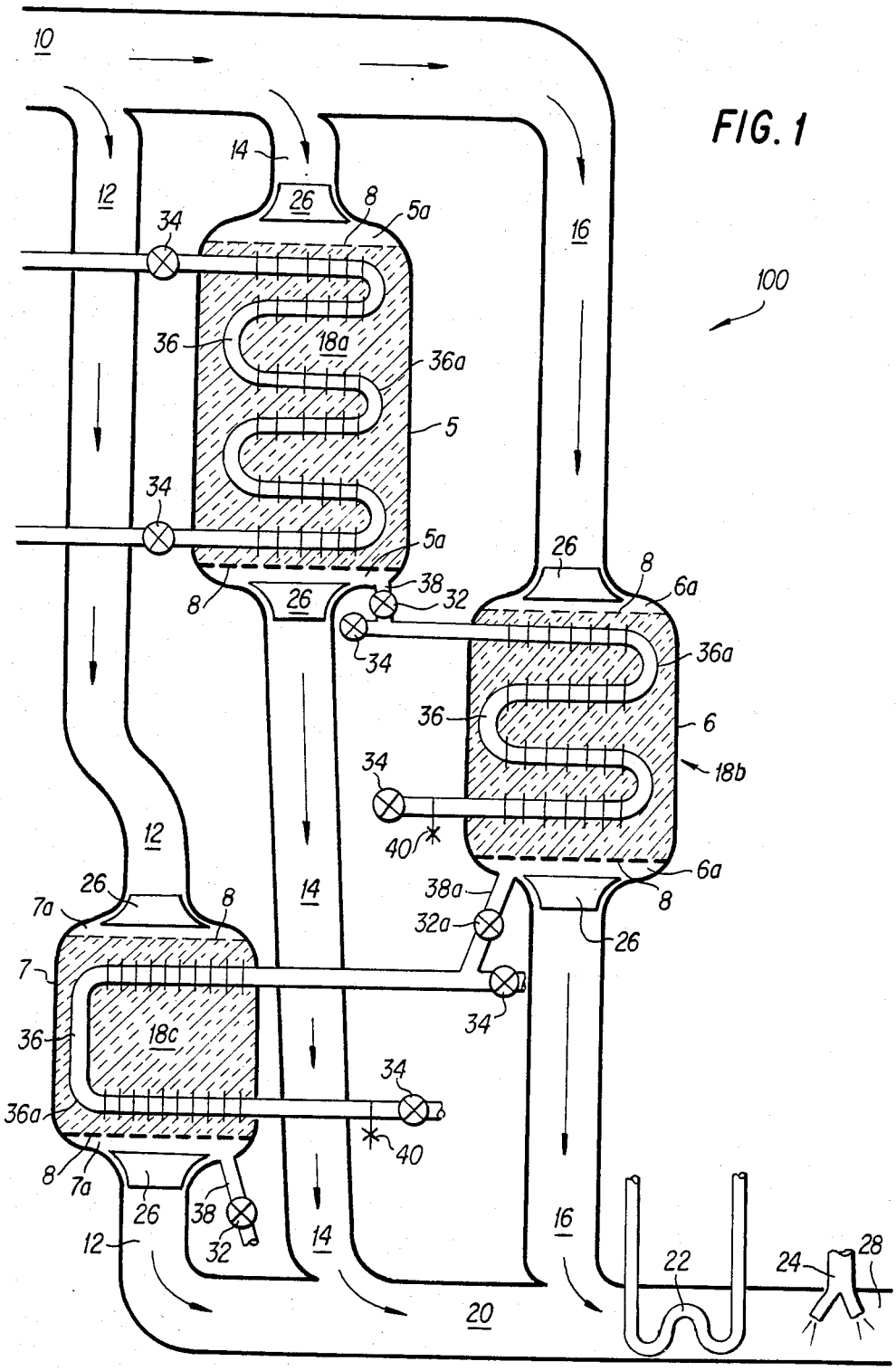
FIG. 1 is a cross-sectional view, partially in schematic form, of a cascade air-conditioning/air drying system having a cold thermal energy storage capability in accordance with the invention.

Referring to FIG. 1, there is shown in cross-section, partially in schematic form, a cascade desiccant air-conditioning/air dryer system 100 in accordance with the present invention. The system 100 consists of three chambers 5, 6, 7 filled with desiccants 18*a*, 18*b*, 18*c*, respectively. These chambers 5, 6, 7 would normally be cylindrical tanks having tapered ends. The desiccant 18 can be silica gel, molecular sieves, activated carbon, or other getters. The desiccant 18 can be in the form of pellets, spheres, and other shapes, or a cindered porous mass. Most of these substances are commercially available in various size pellets and spheres. One-eighth and one-quarter inch diameters are common sizes for pellets and spheres. The desiccants 18*a*, 18*b*, 18*c* must allow air to pass through with a minimum pressure loss. If small desiccant particles are used, screens 8 are required at each end of chambers 5, 6, 7 to constrain the desiccant particles. At each end of the chambers 5, 6, 7 a sealing means 26, such as an air tight valve or plug, is required so that each chamber 5, 6, 7 can be sealed air tight. The chambers 5, 6, 7 and sealing means 26 must be able to withstand and seal appreciable pressures, for example, 70 Psig if a maximum temperature of 300° F. is utilized. This becomes more obvious in the regeneration part of the cycle which is discussed later. Inside of each chamber 5, 6, 7 is a heat exchanger 36. In most cases the heat exchanger 36 will consist of tubing 36*a* through which water or steam can flow. A possible heat exchanger 36 configuration has coil-shaped tubing 36*a* extending from one end of the chambers 5, 6, 7 through the chambers 5, 6, 7 to the other end thereof. To enhance heat transfer, the heat exchanger tubing 36*a* must be placed in a geometry where oscillating temperatures do not cause large stresses in the tubing 36*a*. At the entrance and exit of each heat exchanger 36 are valves 34 which can be shut off. FIG. 1 shows valves 34 cooperating with the heat exchangers 36 of chambers 5, 6, 7. However, the valves 34 are not necessary for the heat exchanger 36 in chamber 5. This will become obvious during the later cycle descriptions. Between chambers 5 and 6 and chambers 6 and 7, a steam line 38 connects an air-section 5*a* of chamber 5 to the heat exchanger 36 of chamber 6, and a steam line 38*a* connects an air-section 6*a* of chamber 6 to the heat exchanger 36 of chamber 7.

These steam lines 38, 38*a* have disposed therein on/off valves 32, 32*a*, respectively. Attached to each end of chambers 5, 6, 7 are air ducts 12, 14, 16. These ducts 12, 14, 16 need only withstand low pressures. The ducts 12, 14, 16 are attached to an incoming air duct 10 at one end, and to an exhaust air duct 20 at the opposite end. Downstream of the exits of the ducts 12, 14, 16 from chambers 5, 6, 7 a cooling heat exchanger 22 and a water injector spray 24 are disposed in the exhaust air duct 20. The heat exchanger 22 is a conventional chilling coil and the water injector 24 functions to spray water into the conditioned air flowing through exhaust air duct 20. Leaving the exhaust air duct 20 at location 28 is chilled air for air-conditioning. If the water injector 24 is deleted, dry air exits exhaust duct 20 at location 28. Heat exchanger 22 is also not required for air drying but could be included.

FIG. 1 shows only three chambers 5, 6, 7. More chambers, however, could be added in series, as described hereinabove, so that the present invention is not to be construed as being limited to three chambers.

The process for this invention is in two phases, the air-conditioning or air drying phase, and the subsequent regeneration phase.

In the air-conditioning or air drying phase, incoming air enters through the incoming air duct 10. The incoming air can be either ambient air or environmentally controlled (recirculated) air or a combination of the two. The incoming air is divided into three flow streams entering the inlet ducts 12, 14, 16 to flow into chambers 5, 6, 7 via air-sections 5*a*, 6*a*, 7*a*, respectively. Valves 26 are open on all chambers. Valves 32, 32*a* between chambers 5 and 6 and between chamber 6 and 7, respectively, are closed. Valves 34 can be either open or closed. If valves 34 are open, cooling fluid flowing through heat exchangers 36 will enhance the performance of the air-conditioning or air drying phase. As the incoming air passes through the desiccants 18*a*, 18*b*, 18*c*, moisture in the incoming air is absorbed by the desiccants 18*a*, 18*b*, 18*c*. In the absorption process, heat is generated. This heat is removed by the cooling fluid passing through the heat exchangers 36. No cooling is required as the temperature can be allowed to increase, heating both the desiccants 18*a*, 18*b*, 18*c* and the air flowing therethrough. However, the process works more efficiently at lower temperatures. The air leaving the chambers 5, 6, 7 is desiccated. For air-drying, the process may stop as the desiccated air enters the exhaust duct 20 or the air may be further cooled by passing through cooling heat exchanger 22. For air-conditioning, the air in the exhaust duct 20 is further cooled by passing through cooling heat exchanger 22. After the air is cooled, water is added to the cooled, desiccated air by the water injector 24 such that the temperature of the cooled, desiccated air drops due to an adiabatic evaporization process. As the water evaporates, energy equivalent to the latent heat of vaporization of the water is absorbed from the cooled, desiccated air. Air properties of the conditioned air equivalent to the exhaust air properties from conventional air-conditioners can be achieved.

As the incoming air passes through chambers 5, 6, 7 the desiccants 18*a*, 18*b*, 18*c* become saturated with water and must be regenerated. In order for this invention to work effectively, the desiccants 18*a*, 18*b*, 18*c* must have absorbed an appreciable amount of water. Absorption to near the saturation point is most efficient. This becomes obvious in the discussion on the regeneration phase.

The regeneration phase is initiated as the desiccants 18*a*, 18*b*, 18*c* approach their saturation points. The incoming air flow is stopped by closure means (not shown) in incoming air duct 10 and valves 26 are closed on each chamber 5, 6, 7. Valves 34 are closed on chambers 6 and 7. Valves 32, 32*a* are opened. A high temperature fluid, normally hot water or steam, passes through the heat exchanger 36 in chamber 5. The addition of heat regenerates the water which has been absorbed in desiccant 18*a*. The regenerated water forms steam at a slightly lower temperature than the heating fluid. This pressurized steam passes from the air-section 5*a* in chamber 5 through the steam line 38 to the heat exchanger 36 in chamber 6. As the steam condenses in the heat exchanger 36 of chamber 6, the water in desiccant 18*b* in chamber 6 is regenerated and again forms steam which is transferred via steam line 38*a* to the heat exchanger 36 in chamber 7. As the steam condenses in the heat exchangers 36 disposed in chambers 6, 7, steam-water separators 40 cooperating with the heat exchangers 36 of chambers 6, 7 allow the condensed water to drain from the heat exchangers 36. The steam from the last chamber, chamber 7 in this case, is discarded. The temperature of the steam generated in any given stage is less than the temperature of the steam generated in the preceding stage. A major change in the thermal coefficient of performance of the system results from the recovery of the latent heat of vaporization in the water vapor absorbed by the desiccants 18*a*, 18*b*, 18*c*. In other desiccant systems, the water vapor is discarded with the air flow. A residual quantity of steam remains in the air-sections 5*a*, 6*a*, 7*a* of the chambers 5, 6, 7 and in the heat exchangers 36 and this fraction of the input energy is lost. This percentage decreases with an increase in the saturation level of desiccants 18*a*, 18*b*, 18*c*. As a result, regeneration near the saturation point of desiccants 18*a*, 18*b*, 18*c* is more efficient. Minimizing the volume of the heat exchangers 36, where the latent heat of vaporization of the residual volume of steam is lost, also maximizes efficiency. The mass of the chambers 5, 6, 7, the desiccants 18*a*, 18*b*, 18*c*, heat exchangers 36, and other components absorb sensible heat as the temperature rises. This energy is also lost in each cycle. Therefore, these masses must be minimized to ensure maximum performance. Insulation will cover chambers 5, 6, 7, piping, etc. to minimize additional energy losses. These percentage losses become smaller as the system increases in physical size. Due to energy losses in each stage (chamber and related equipment), less energy is available for succeeding stages. As a result, each succeeding stage (chambers and related equipment) will have to be smaller or have an additional source of energy. Adding extra energy defeats the purpose of the present invention. As a result, FIG. 1 shows each succeeding stage slightly smaller.

At the completion of the regeneration phase, an air-chilling capability, without any additional energy, exists until the desiccants 18*a*, 18*b*, 18*c* again require regeneration. This results in cold thermal energy storage system without thermal losses. In a system at 55° F., for example, heat continuously leaks into the system resulting in thermal energy storage losses. A zero-loss thermal energy storage capability is inherent to the present invention.

Figure 2:
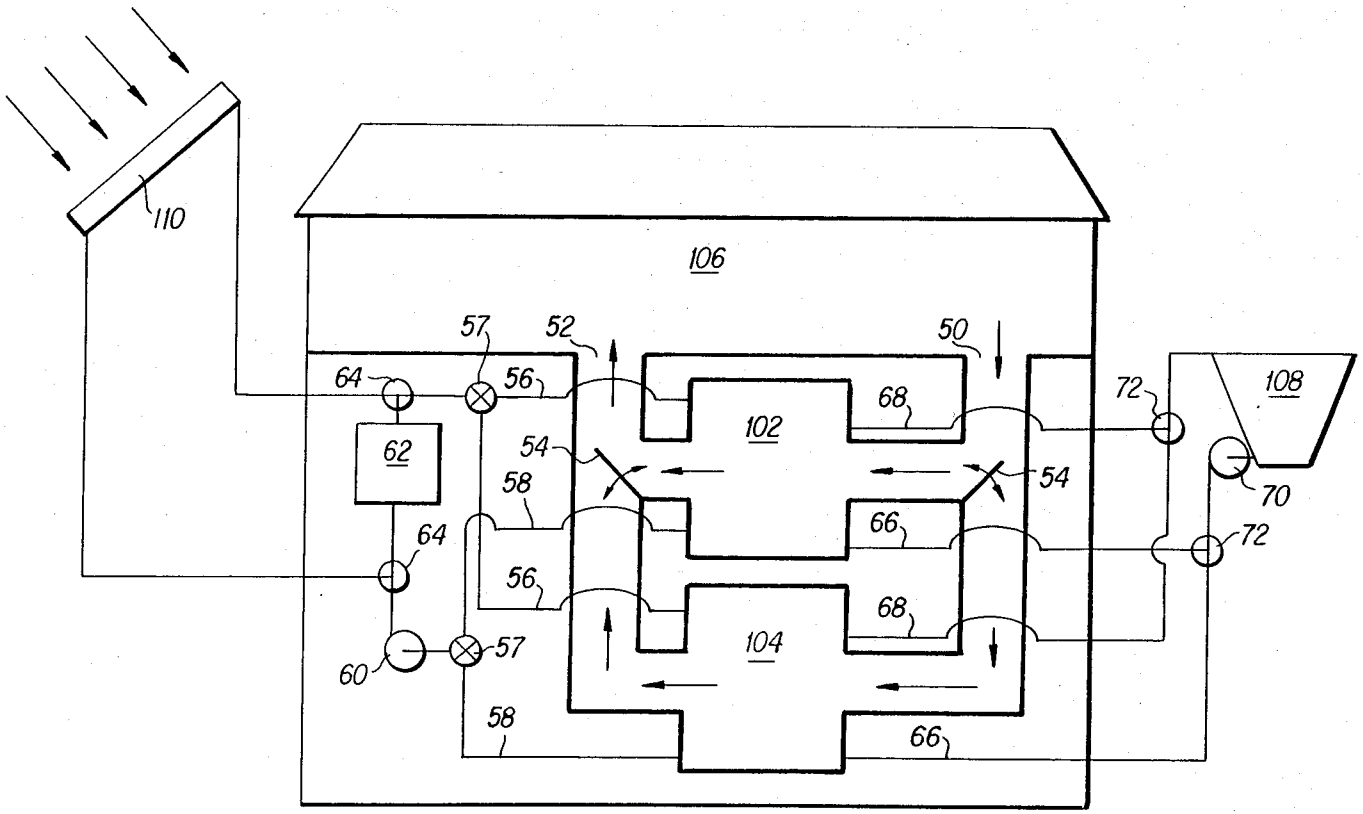
FIG. 2 is a schematic of an application of the cascasde air-conditioning system and cold thermal energy storage system of the present invention to a home using conventional energy or solar energy with a conventional energy backup source.

For a continuously operating system, more than one of the systems 100 in FIG. 1 must be utilized. A first system 100 can be air-conditioning while other systems 100 are regenerating. FIG. 2 is a schematic of an application of the cascade desiccant air-conditioning system having a cold thermal energy storage capability 100 to a home. The air-conditioning cascade and thermal energy storage systems 100 in FIG. 1 are denoted as systems 102 and 104 in FIG. 2. Different numbers are assigned so a differentiation can be made between the operation of the two systems 100. A home environment 106 is air-conditioned by systems 102 and 104. The controlled environment air from the home 106 enters inlet duct 50 and is channeled through system 102 or 104 and back into the outlet duct 52 by two-way valves 54. The system 102 (or 104) which is being used for the air-conditioning phase is in a regenerated state. The other system 104 (or 102) can be in the regeneration process. Either a conventional heater 62 or a solar collector 110 is used to provide the hot water. The hot water is circulated by a pump 60 switched to either the solar collector 110 or conventional heater 62 by valves 64 and then to systems 102, 104 by inlet lines 56. Return lines 58 from systems 102, 104 complete the hot water flow circuit. Two way valves 57 in inlet lines 56 and return lines 58 direct the flow of hot water to the system 102 or 104 undergoing regeneration. No solar collector 110 is required in a conventional system which would use only the conventional heater 62 for energy. In a solar system the conventional heater 62 is used only for backup when solar energy is not available.

If systems 102 and 104 are sized to contain the quantity of cooling required for a day's air-conditioning, one system 102 (or 104) can be used for air-conditioning and the other system 104 (or 102) used for regeneration in a 24-hour period. If system 102 or 104 is not regenerated by solar energy during the day, because of a lack of insolation for example, the system 102 or 104 can be regenerated at night during off-peak hours. Therefore this solar energy air-conditioner will not increase the peak load on electric power plants as conventional solar systems do. The inherent internal cold thermal energy storage capability contributes to the versatility of the present invention.

Inherent cooling can be accomplished by circulating cool water to systems 102 and 104. The water can be cooled by a cooling tower 108, circulated by a pump 70 and switched to inlet cooling lines 68, return cooling lines 66, and the system 102 or 104 air-conditioning by two-way valves 72. The cooling could be provided by ambient air as in most conventional air-to-air air-conditioners. However, using the cooling tower 108 to provide near or below ambient temperature cooling, as in many gas fired absorption air-conditioners, increases the thermal coefficient of performance.

The invention has been described with reference to a particular embodiment; however, variations will occur to those skilled in the art of desiccant air-conditioning or drying systems. A critical feature of this invention is the recovery of the latent heat of vaporization of the water vapor regenerated from the desiccant through a cascade recovery system wherein each succeeding desiccant stage undergoing regeneration is at a slightly lower pressure and temperature.

Figure 3:
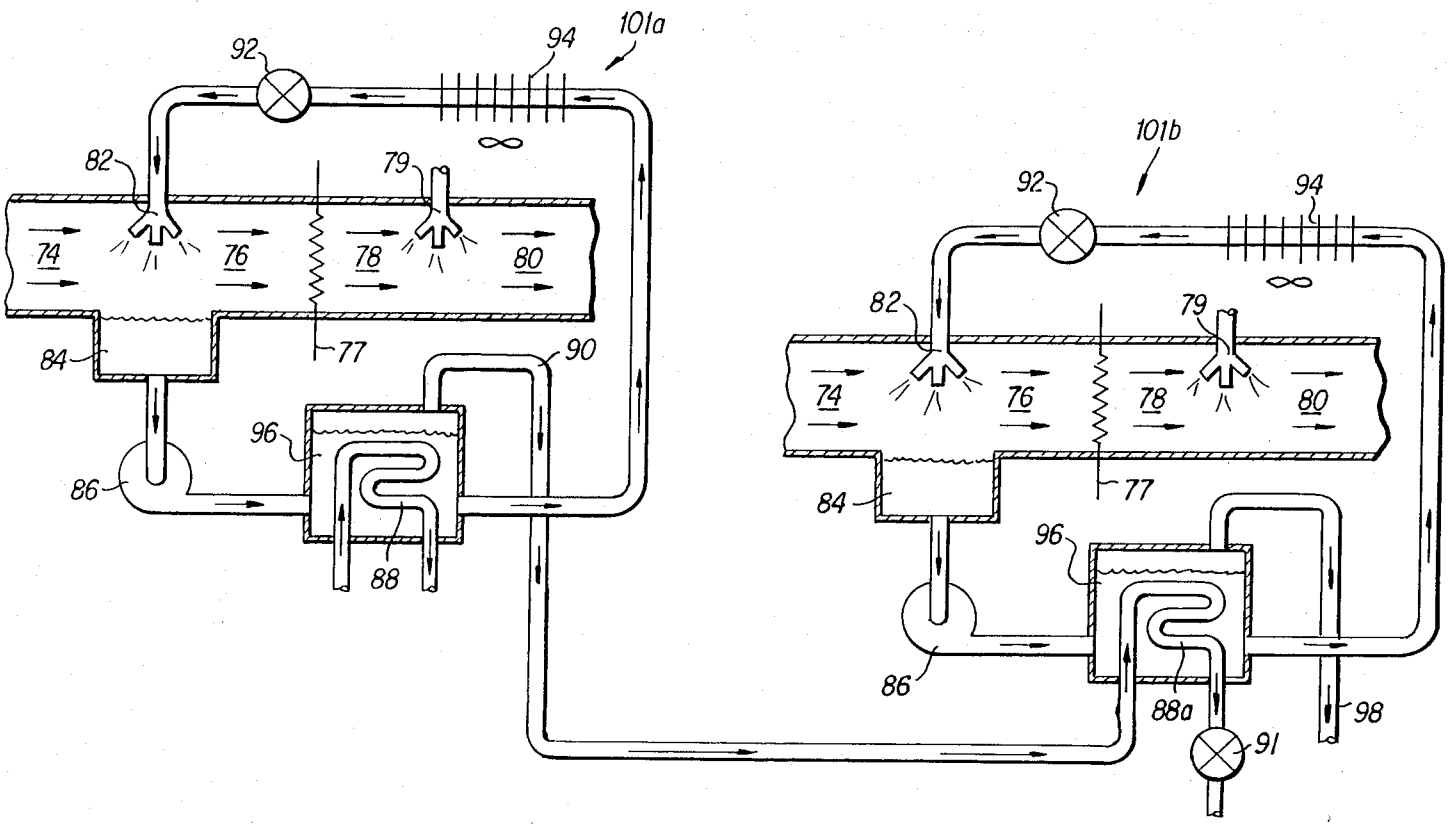
FIG. 3 is a schematic depicting the cascade air-conditioning/air drying process for a continuously operating system using liquid desiccant in accordance with the present invention.

FIG. 3 is a schematic of a liquid desiccant system for continuous air-conditioning/air drying using the cascade process to increase the thermal coefficient of performance. Two cascade stages 101*a*, 101*b* are show; however, any number of stages are possible. In each of the stages 101*a*, 101*b* the following sequence takes place. The sequence described hereinbelow is for system 101*a* of FIG. 3. Air enters at 74 and is dryed by flowing through a desiccant spray 82 to subsequently leave as warm dry air at 76. The warm dry air is cooled in a cooling coil 77 and leaves as dry cool air at 78. The cool dry air is injected with water by a water injector 79 and leaves as cold air at 80. The moisture-laden desiccant spray 82 collects in a basin 84, is then pumped to a relatively high pressure by a high pressure pump 86 and is heated in a container 96 by heating means 88 to regenerate the water as steam from the moisture-laden desiccant. The steam generated in the container 96 flows through a line 90 to the next cascade stage (shown as 101*b* in FIG. 3) and condenses in the heating means 88*a*, recovering its latent heat of vaporization through the regeneration of water as steam in this stage. Steam generated in container 96 of syste 101*b* is then transferred via line 98 to the heating means 88*x* of a subsequent stage to regenerate the liquid desiccant contained in the subsequent stage, if desired. Condensed water in the heating means 88*a* of system 101*b*, and subsequent systems, is released through water separators 91. The desiccant liquid is cooled by a heat exchanger 94 and passes through a flow control valve 92 and completes the desiccant cycle by being sprayed back into the entering air through desiccant spray 82. The quantity of liquid desiccant allows an inherent cold thermal energy storage system with a zero loss. The tank 84 holding the liquid desiccant after regeneration can be used as an active cold thermal energy storage means with zero loss. The high pressure pump 86 is required to allow a temperature drop to the next cascade stage. The pressure is reduced in each successive stage. For example, in a first stage a saturation pressure of 70 psia assures a steam temperature of over 300° F. In a second stage, a saturation pressure of 30 psia would guarantee a temperature of regenerated steam of greater than 250° F. but still assure the condensation of the 70 psia steam. The work input into this high pressure pump 86 is relatively low.

Figure 4:
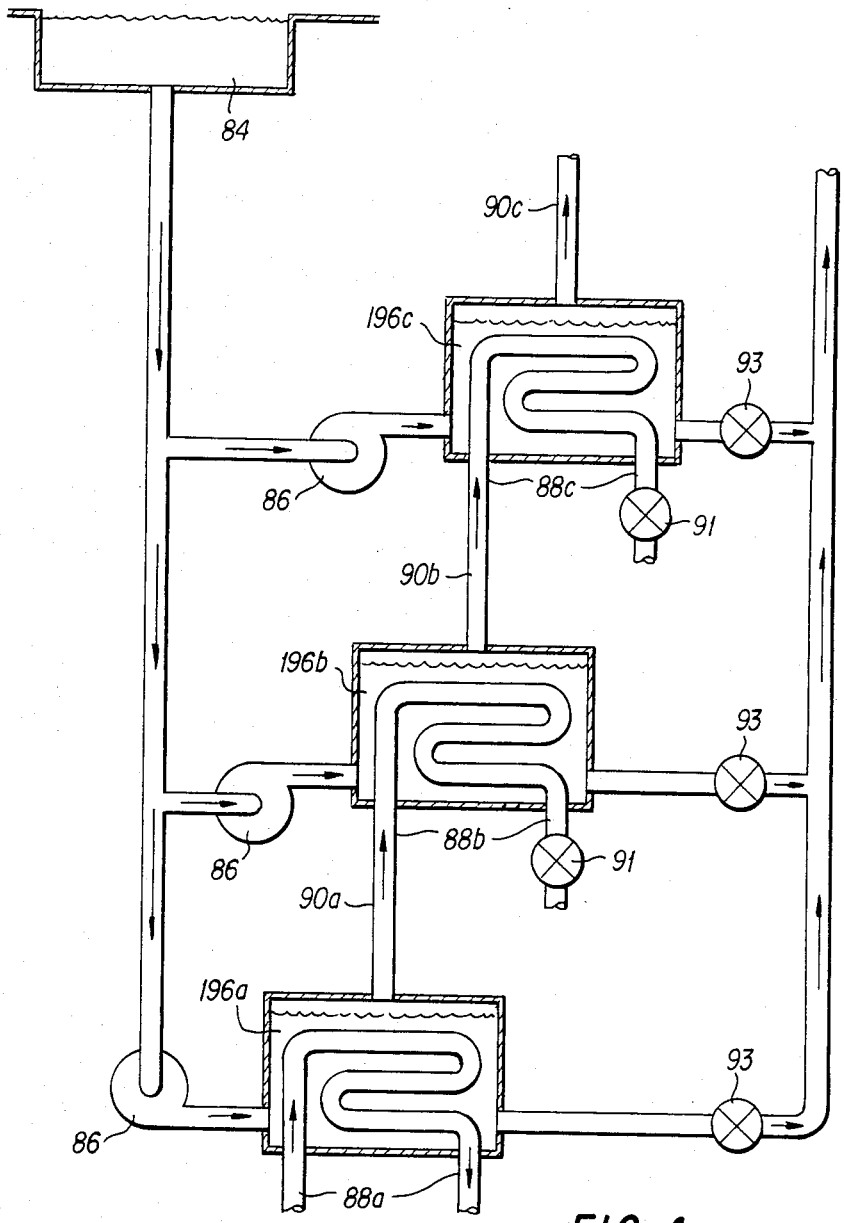
FIG. 4 is a schematic depicting a cascading arrangement for regenerating liquid desiccant in the cascade air-conditioning/air drying process.

An alternative to the stages 101*a*, 101*b* as complete systems as shown in FIG. 3, is to limit the stages to the regeneration container 96. FIG. 4 shows a schematic where regeneration container 96 has been broken into three stages using the cascade principle. The saturated liquid desiccant leaving the basin 84 is divided into three streams, pressurized by the high pressure pumps 86 and transferred to containers 196*a*, 196*b*, 196*c*. The desiccant in lower container 196*a* is at the highest pressure. External thermal energy is transferred to lower container 196*a* and the liquid desiccant contained therein is regenerated with the water being released as steam through line 90*a*. This steam regenerates the desiccant in the next stage or container 196*b* with a similar process occurring in container 196*c*. The regenerated liquid desiccant leaves the containers 196*a*, 196*b*, 196*c* through pressure regulators and flow controllers 93. The pressure regulators and flow controllers 93 control the saturation pressure in the containers 196*a*, 196*b*, 196*c* and thereby control the temperature. The regenerated liquid desiccant continues through the regeneration cycle as shown in FIG. 3. The condensed water in the heating means 88*x* of the second, third, etc. stages is released through water separators 91. Utilizing this cascade arrangement allows the latent heat of vaporization of the regenerated water vapor to be recovered. The steam from the last stage could be used to preheat the liquid desiccant entering the various stages thereby saving the latent heat of vaporization from all stages.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cascade desiccant air-conditioning process for conditioning an air flow utilizing a plurality of desiccating means, comprising:

desiccating said air flow by removing moisture therefrom to produce a desiccated air flow, wherein said step of desiccating said air flow further comprises passing said air flow through said plurality of desiccating means such that said moisture of said air flow is absorbed by said plurality of desiccating means;

cooling said desiccated air flow to produce a cooled, desiccated air flow by passing said desiccated air flow through heat exchanging means;

chilling said cooled, desiccated air flow to produce a conditioned air flow, wherein said step of chilling said cooled, desiccated air flow further comprises injecting water into said cooled, desiccated air flow such that said water is adiabatically evaporated by said cooled, desiccated air flow to lower a temperature of said cooled, desiccated air flow;

exhausting said conditioned air flow; and desorbing said moisture absorbed by said plurality of desiccating means as steam in a cascade manner wherein a first steam produced by desorbing serves as an energy source for subsequent desorbing to produce a second steam such that a major increase in a thermal coefficient of performance of said cascade desiccant air-conditioning process is effected by recovering a latent heat of vaporization of said moisture through desorption of said moisture from said plurality of desiccating means as said first and second steam.

2. A cascade desiccant air-conditioning process as claimed in claim 1 wherein said step of desorbing said moisture further comprises:

passing a high temperature fluid through first heat exchanging means cooperating with first desiccating means of said plurality of desiccating means to desorb moisture absorbed by said first desiccating means as a first steam having a first temperature; and passing said first steam through second heat exchanging means cooperating with second desiccating means of said plurality of desiccating means, said first steam condensing in said second heat exchanging means to desorb moisture absorbed by said second desiccating means as a second steam having a second temperature and wherein said second temperature is less than said first temperature.

3. A cascade desiccant air-conditioning process as claimed in claim 1 wherein said step of desorbing said moisture absorbed by said plurality of desiccating means further comprises regenerating said plurality of desiccating means to generate a plurality of zero loss cold thermal energy storage means such that air flowing through said plurality of zero loss cold thermal energy storage means is chilled without an additional energy input.

4. A cascade desiccant air drying process for conditioning an air flow utilizing a plurality of desiccating means, comprising:

desiccating said air flow by removing moisture therefrom to produce a desiccated air flow, wherein said step of desiccating said air flow further comprises passing said air flow through said plurality of desiccating means such that said moisture of said air flow is absorbed by said plurality of desiccating means;

cooling said desiccated air flow to produce a cooled, desiccated air flow by passing said desiccated air flow through heat exchanging means;

exhausting said cooled, desiccated air flow; and desorbing said moisture absorbed by said plurality of desiccating means as steam in a cascade manner wherein a first steam produced by desorbing serves as an energy source for subsequent desorbing to produce a second steam such that a major increase in a thermal coefficient of performance of said cascade desiccant air drying process is effected by recovering a latent heat of vaporization of said moisture through desorption of said moisture from said plurality of desiccating means as said first and second steam.

5. A cascade desiccant air drying process as claimed in claim 4 wherein said step of desorbing said moisture further comprises:

passing a high temperature fluid through first heat exchanging means cooperating with first desiccating means of said plurality of desiccating means to desorb moisture absorbed by said first desiccating means as a first steam having a first temperature; and passing said first steam through second heat exchanging means cooperating with second desiccating means of said plurality of desiccating means, said first steam condensing in said second heat exchanging means to desorb moisture absorbed by said second desiccating means as a second steam having a second temperature and wherein said second temperature is less than said first temperature.

6. A cascade desiccant air drying process as claimed in claim 4 wherein said step of desorbing said moisture absorbed by said plurality of desiccating means further comprises regenerating said plurality of desiccating means to generate a plurality of zero loss cold thermal energy storage means such that air flowing through said plurality of zero loss cold thermal energy storage means is chilled without an additional energy input.

7. A cascade desiccant air-conditioning/air drying apparatus for conditioning an air flow, comprising:

first flow ducting means for conducting said air flow therein;

first and second desiccating means operatively associated with said first flow ducting means for removing moisture from said air flow wherein said moisture in said air flow is desorbed therefrom by circulating said air flow through said first and second desiccating means to produce a desiccated air flow;

second flow ducting means operatively associated with said first and second desiccating means for receiving said desiccated air flow;

cooling means associated with said second flow ducting means for cooling said desiccated air flow to produce a cooled, desiccated air flow and wherein said cooled, desiccated air flow is subsequently exhausted from said second flow ducting means;

first heat exchanging means adapted to cooperate with said first desiccating means for desorbing moisture therefrom;

second heat exchanging means adapted to cooperate with said second desiccating means for desorbing moisture therefrom;

steam piping means interconnecting said first desiccating means to said second heat exchanging means for conducting a first steam produced in said first desiccating means to said second heat exchanging means;

exhausting means operatively associated with said second desiccating means for removing a second steam produced in said second desiccating means; and isolating means operatively associated with said first and second desiccating means and first and second flow ducting means for alternately isolating said first and second desiccating means from said first and second flow ducting means and wherein when said isolating means isolates said first and second desiccating means from said first and second flow ducting means a high temperature fluid flowing through said first heat exchanging means desorbs moisture absorbed by said first desiccating means as said first steam having a first temperature, and said first steam is conducted through said steam piping means to said second heat exchanging means and condenses therein to desorb moisture absorbed by said second desiccating means as said second steam having a second temperature less than said first temperature, and said second steam is removed from said second desiccating means by passing through said exhausting means and wherein a major increase in a thermal coefficient of performance of said cascade desiccant air-conditioning/air drying apparatus is effected by recovering a latent heat of vaporization of said moisture through desorption of said moisture from said first and second desiccating means as said first and second steam.

8. A cascade desiccant air-conditioning/air drying apparatus as claimed in claim 7 further comprising:

moisture injecting means associated with said second flow ducting means for chilling said cooled, desiccated air flow prior to subsequent exhaustion from said second flow ducting means.

9. A cascade desiccant air-conditioning/air drying apparatus as claimed in claim 8 wherein said first and second desiccating means further comprise:

first and second containers operatively associated with said first and second flow ducting means;

first and second desiccants disposed in said first and second containers, respectively.

10. A cascade desiccant air-conditioning/air drying apparatus as claimed in claim 7 wherein said first and second desiccating means further comprise:

first and second containers operatively associated with said first and second flow ducting means;

first and second desiccants disposed in said first and second containers, respectively.

11. A cascade desiccant air-conditioning/air drying apparatus for conditioning an air flow, comprising:

first and second flow ducting means for conducting said air flow therein;

first and second desiccant spraying means operatively associated with said first and second flow ducting means, respectively, for removing moisture from said air flow wherein said moisture in said air flow is desorbed therefrom by injecting said air flow with first and second liquid desiccant sprays from said first and second desiccant spraying means, respectively, to produce a desiccated air flow;

first and second cooling means associated with said first and second flow ducting means, respectively, for cooling said desiccated air flow to produce a cooled, desiccated air flow and wherein said cooled, desiccated air flow is subsequently exhausted from said first and second flow ducting means;

first and second collecting basins operatively associated with said first and second flow ducting means, respectively, for collecting first and second moisture-laden liquid desiccants, respectively, after said first and second liquid desiccant sprays have passed through said air flow and absorbed said moisture therefrom;

first and second high pressure pumping means operatively associated with said first and second collecting basins, respectively, for pumping said first and second moisture-laden liquid desiccants from said first and second collecting basins, respectively, and wherein said first and second high pressure pumping means are adapted to operate such that said first moisture-laden liquid desiccant is pumped from said first collecting basin by said first high pressure pumping means at a first predetermined pressure and said second moisture-laden liquid desiccant is pumped from said second collecting basin by said second high pressure pumping means at a second predetermined pressure and wherein said first predetermined pressure is greater than said second predetermined pressure;

first and second containers operatively associated with said first and second high pressure pumping means, respectively, for receiving said first and second moisture-laden liquid desiccants, respectively;

first heating means operatively associated with said first container for desorbing said first moisture-laden liquid desiccant by heating thereof such that a first liquid desiccant and a first steam having a first predetermined temperature are produced in said first container;

second heating means operatively associated with said first and second containers for desorbing said second moisture-laden liquid desiccant by condensing said first steam in said second heating means such that a second liquid desiccant and a second steam having a second predetermined temperature are produced in said second container thereby recovering a latent heat of formation of said first steam by generating said second steam;

water separator means operatively associated with said second container for removing said second steam therefrom; and first and second cycling means operatively associated with said first and second containers, respectively, and said first and second desiccant spraying means, respectively for transferring said first and second liquid desiccants to said first and second desiccant spraying means, respectively, such than an operating cycle for said cascade desiccant air-conditioning/air drying apparatus is maintained continuously.

12. A cascade desiccant air-conditioning/air drying apparatus as claimed in claim 11 further comprising first and second water injecting means operatively associated with said first and second flow ducting means, respectively, for chilling said cooled, desiccated air flow prior to subsequent exhaustion from said first and second flow ducting means.

* * * * *